US006368293B1

(12) United States Patent
Orgeron et al.

(10) Patent No.: US 6,368,293 B1
(45) Date of Patent: Apr. 9, 2002

(54) RELAXATION DEVICE

(76) Inventors: Eric P. Orgeron, 108 Garden Rd., River Ridge, LA (US) 70123; Philip J. Delatte, 4535 Rosedale Dr., Metairie, LA (US) 70001

( * ) Notice: Subject to any disclaimer, the term of this patent is extended or adjusted under 35 U.S.C. 154(b) by 0 days.

(21) Appl. No.: 09/471,968

(22) Filed: Dec. 23, 1999

Related U.S. Application Data

(60) Provisional application No. 60/113,748, filed on Dec. 23, 1998.

(51) Int. Cl.[7] ..... A61H 1/00
(52) U.S. Cl. ..... 601/15; 601/15
(58) Field of Search ..... 601/46, 49, 67, 601/89, 70, 71, 75, 122, 119, 15; 600/9; 606/201, 204.15

(56) References Cited

U.S. PATENT DOCUMENTS

| | | | | |
|---|---|---|---|---|
| 3,763,853 A | | 10/1973 | Jochimski | |
| 4,469,092 A | | 9/1984 | Marshall et al. | |
| 4,979,502 A | * | 12/1990 | Hunt | 601/15 |
| 5,081,986 A | * | 1/1992 | Cho | 601/144 |
| 5,092,835 A | * | 3/1992 | Schurig et al. | 600/9 |
| 5,099,829 A | * | 3/1992 | Wu | 601/46 |
| 5,188,097 A | | 2/1993 | Hansen | |
| 5,405,311 A | | 4/1995 | Pecora et al. | |
| 5,421,799 A | | 6/1995 | Rabin et al. | |
| 5,486,156 A | | 1/1996 | Takach | |
| 5,632,721 A | * | 5/1997 | Kuan | 601/135 |
| 5,713,832 A | * | 2/1998 | Jain | 601/49 |
| 5,738,624 A | * | 4/1998 | Zablotsky et al. | 600/9 |
| 5,807,287 A | * | 9/1998 | Cheng | 601/60 |
| 5,836,645 A | | 11/1998 | Sakaue et al. | |
| 5,857,986 A | * | 1/1999 | Moriyasu | 601/49 |
| 5,928,262 A | * | 7/1999 | Harber | 606/204.35 |
| 5,950,239 A | | 9/1999 | Lopez | |
| 6,050,265 A | * | 4/2000 | Richardson | 5/632 |

FOREIGN PATENT DOCUMENTS

| | | | |
|---|---|---|---|
| DE | 3537211 A | * 10/1985 | 601/46 |

* cited by examiner

*Primary Examiner*—Justine R. Yu
(74) *Attorney, Agent, or Firm*—Garvey, Smith, Nehrbass & Doody, L.L.C.

(57) ABSTRACT

Apparatus (110) for facilitating relaxing includes a helmet (120) made of a soft material, a vibration source (41) in the helmet, and a relatively hard transmission network (30) for transmitting vibration from the vibration source throughout the helmet. Preferably, there is a power source (42) remote from the helmet for powering the vibration source (41) in the helmet (120) so that the user is not exposed to EMF from the power source (42). This can be accomplished by having a flexible shaft (44), with one end of the shaft (44) at the power source 42 and the other end terminating in the vibration source (41) in the helmet (20). Preferably, there are handles (61) on the helmet (120) to allow a facilitator to help a user use the apparatus (110) by holding onto the handles (61) while vibration occurs. An optional auxiliary pressure source (70) can be used by the facilitator or by an additional facilitator to apply more pressure during vibration. Adjustment slits (50) allow fine tuning of the shape of the helmet. Strap guides (55) help secure a strap (not shown) which is used to adjust the shape of the helmet (120) by pulling the strap tight around the helmet.

19 Claims, 5 Drawing Sheets

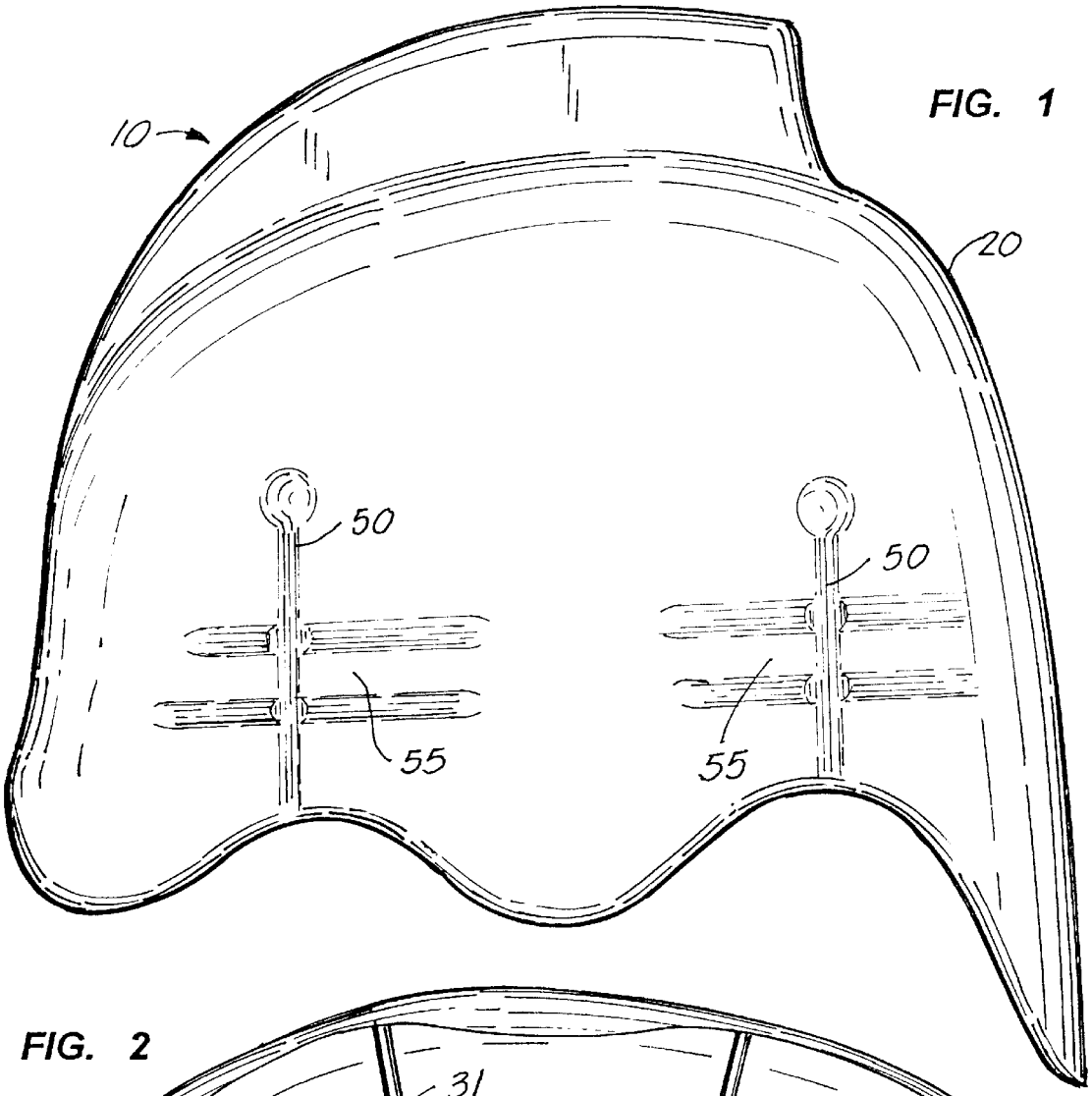
FIG. 1
FIG. 2
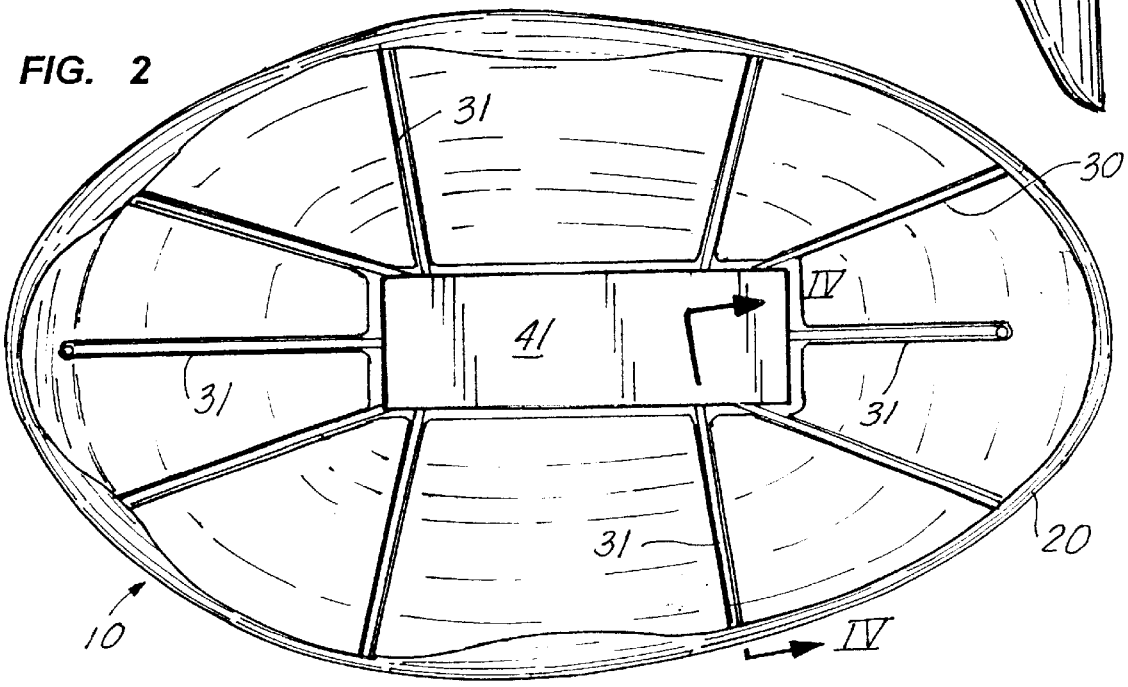

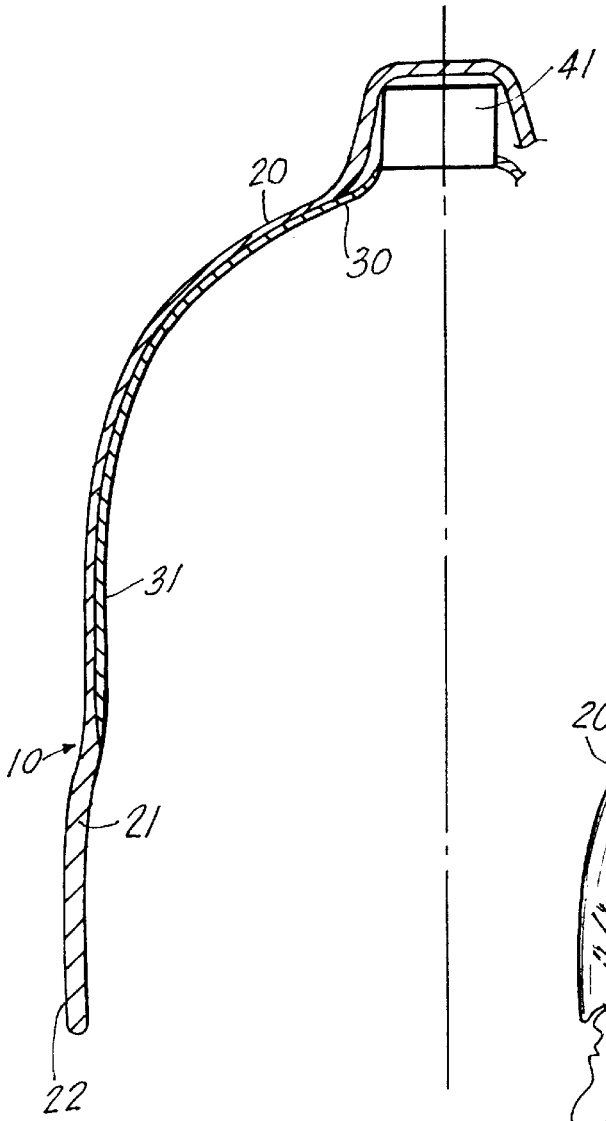
FIG. 4
FIG. 3
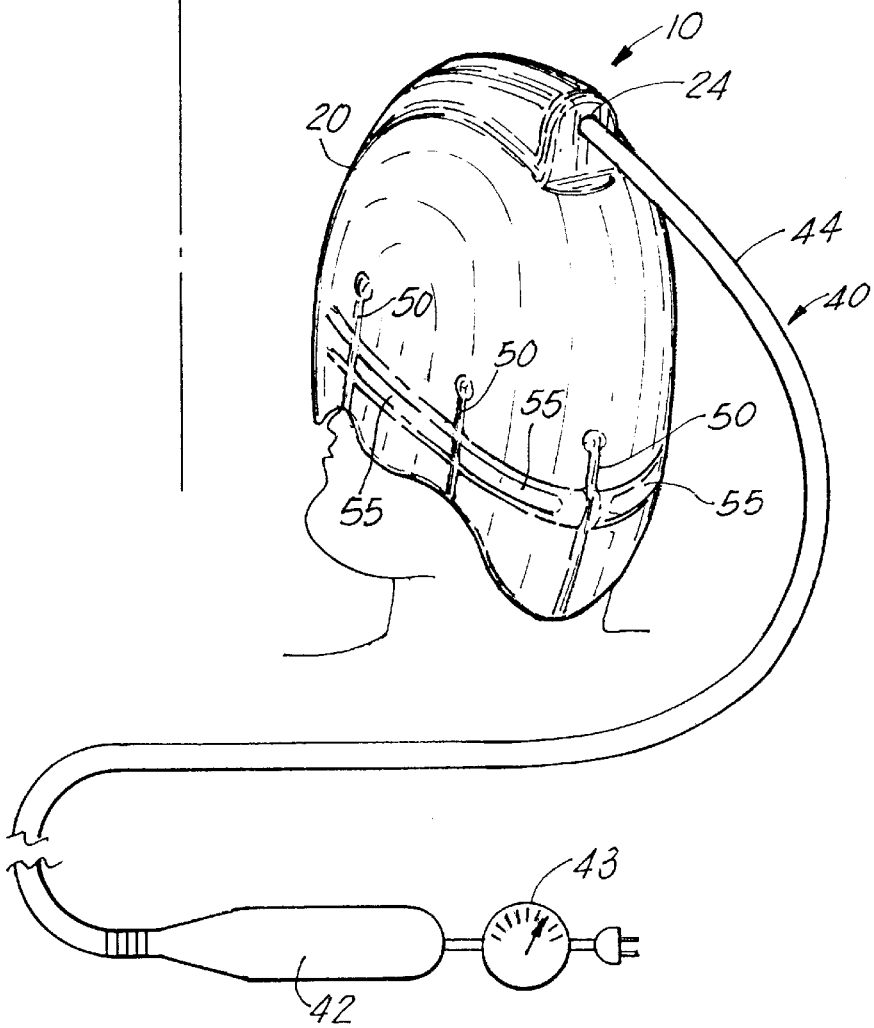

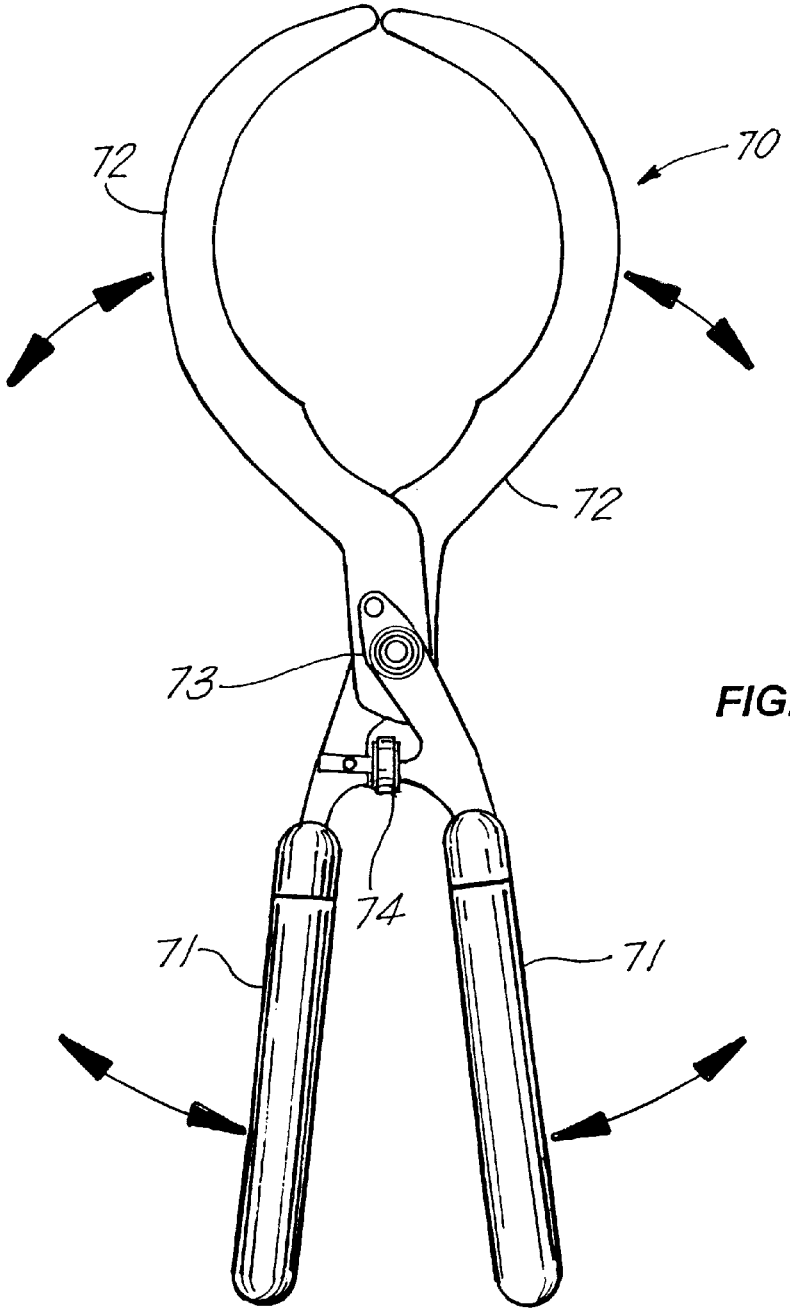
FIG. 9
FIG. 10
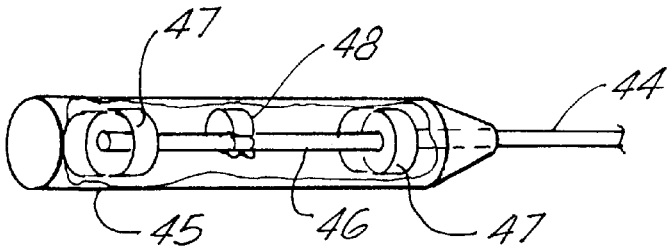

RELAXATION DEVICE

CROSS-REFERENCE TO RELATED APPLICATIONS

Priority of U.S. Provisional Patent Application Serial No. 60/113,748, filed Dec. 23, 1998, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to relaxation devices. More particularly, the present invention relates to vibrating headgear for providing relaxation.

2. General Background of the Invention

Vibrating head gear is known from, for example, the following U.S. Patents which are incorporated herein by reference: 3,763,853; 5,421,799; and 5,486,156.

BRIEF SUMMARY OF THE INVENTION

The apparatus of the present invention solves the problems confronted in the art in a simple and straightforward manner. What is provided is a vibrating helmet which is preferably made of a relatively soft, pliable material, with a relatively hard material, such as PVC (polyvinylchloride), ABS, PET, HDPE (high density polyethylene), urethane elastomer, or rigid lastisol, recessed therein in a network to transmit vibration from a central vibrator means throughout the helmet. However, only the soft, pliable material makes contact with the user's head. The vibrator means could advantageously include a motor. A variable speed control is preferably used to vary the intensity of vibration. Such a control could be a potentiometer. There can be, for example, a hard plastic shell outside of the soft, pliable material.

Preferably, the electric source of vibration is remote from the helmet to avoid any potential problems with EMF (electromagnetic field) too close to the user's head. The mechanical means of vibration is in the helmet but the electrical portion for powering the mechanical means is remote from the user's head.

The present invention reduces tension and helps one relax.

A further advantage of the present invention is the utilization of ceramic magnets to further the effects of the device's blood flow increase principle which is to relax the user by the increase of blood flow to the head area of the human body.

Magnets are known to increase or produce increased blood flow by placing the north pole or positive-facing side of the magnet towards the body section to which increased blood flow is desired but the effect or therapeutic value of the use of magnet energy on the human body is thought to be effective because of the oscillation of the magnet by the movement of the user's body.

The present invention due to the vibratory nature of its internal mechanism promotes this oscillation effect thus creating a new and improved method for the use of ceramic magnets as in the increased blood flow to the head area of the human body.

The magnets used in the present invention may be of various sizes, shapes and strengths, e.g., 0.250 inch (6.35 mm) thick×0.250 inch (6.35 mm) diameter or 0.375 inch (9.525 mm) thick×0.750 inch (19.05 mm) diameter in a grade 1 or grade 5 type magnet but preferably a grade 5 type magnet in the 1250 through 3500 gauss range and may be attached to the inside of the helmet's hard outer foam casing or hard plastic shell by means of an adhesive such as glue and or by the molding of the magnets into the core of the hard outer foam casing or hard plastic shell during the manufacturing process.

Another embodiment of the invention is a vibrating chair for use with the helmet—the chair has an indentation for receiving the helmet and a vibratory vertical foot rest which preferably vibrates at about the same frequency as the helmet.

The major advantage of the chair is that it allows one to recline while using the helmet without losing any of the vibration of the helmet.

A first embodiment of the invention is apparatus for facilitating relaxing, comprising a helmet made of a soft material, a vibrating means in the helmet, and a relatively hard transmission means for transmitting vibration from the vibrating means throughout the helmet.

Another embodiment of the present invention is apparatus for facilitating relaxing, comprising a helmet made of a soft material, a vibrating means in the helmet, and a power source remote from the helmet for powering the vibrating means in the helmet so that the user is not exposed to EMF from the power source.

Another embodiment of the present invention is apparatus for facilitating relaxing, comprising a helmet made of a soft material,a vibrating means in the helmet, and magnets in or on the helmet.

Yet another embodiment of the present invention is pparatus for facilitating relaxing, comprising a clamping apparatus, for use in conjunction with a helmet made of a soft material and having a vibrating means in the helmet, including opposed gripping jaws and handles for moving the gripping jaws from a position in which the gripping jaws are open and can freely move over the helmet to a position in which the gripping jaws are closed and put pressure on the helmet.

The present invention also includes a method of facilitating relaxing, comprising providing the apparatus of any embodiment of the invention and using the apparatus to relax.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 1 is a side view of a first embodiment of the helmet apparatus of the present invention;

FIG. 2 is a bottom view of the first embodiment of the helmet apparatus of the present invention;

FIG. 3 is a perspective view of the first embodiment of the helmet apparatus of the present invention shown on a user;

FIG. 4 is a cutaway view of the first embodiment of the helmet apparatus of the present invention;

FIG. 9 is a top view of the preferred embodiment of the auxiliary pressure apparatus of the present invention; and FIG. 10 is a schematic view of a vibrating source of the present invention.

DETAILED DESCRIPTION OF THE INVENTION

Figure 5:
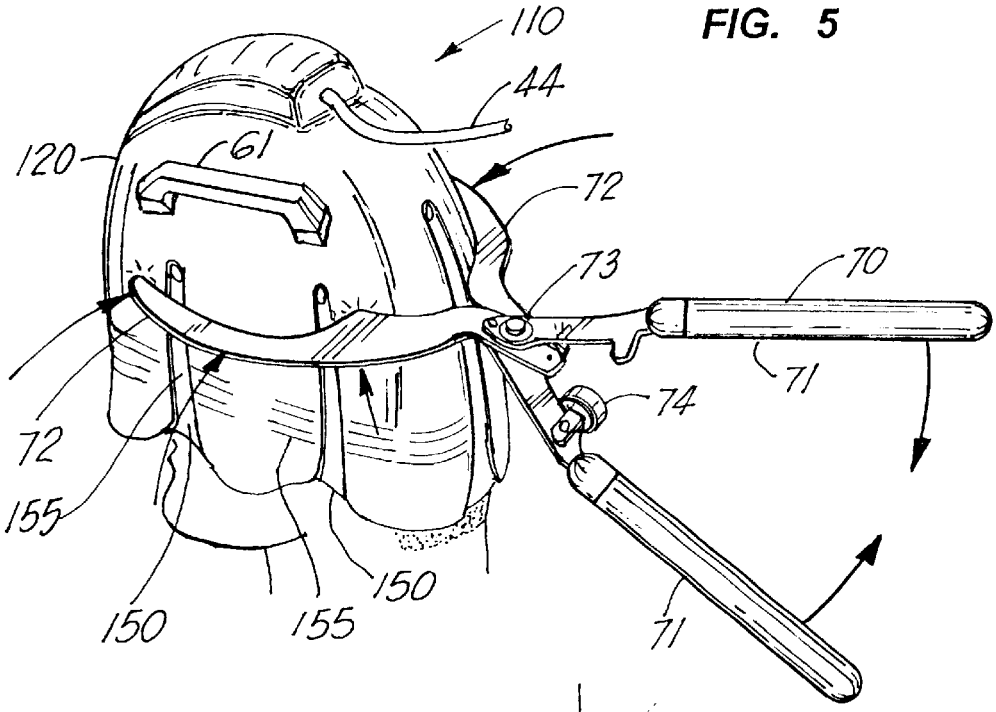
FIG. 5 is a perspective view of the preferred embodiment of the helmet apparatus of the present invention shown on a user.

FIG. 1 is a side view of a first embodiment of the helmet apparatus 10 of the present invention. Helmet apparatus 10 includes a vibrating helmet 20 which is preferably made of an inner shell 21 made of relatively soft, pliable material, such as number 2 ester foam, with an optional outer shell 22 of, for example, self skinning urethane foam. Helmet apparatus 10 can also optionally include a relatively hard material, such as PVC or other injection molded plastic, recessed in inner shell 21 in helmet 20 in a network 30 to transmit vibration from the central vibrating source 41 of a vibrator means 40 throughout the helmet 20. Vibration is transmitted through the self skinning urethane foam shell 22 and through the network 30. However, only the soft, pliable material of inner shell 21 makes contact with the user's head. The soft, pliable material of inner shell 21 is preferably provided as a separate unit so that various thicknesses and/or shapes can be used to fit various head sizes. The soft pliable material of the inner shell 21 may also have a hard inner surface liner that may be glued or fastened by mechanical means to the soft inner shell that is similar to a floor mat type design that has protruding fingers that are made of a rubber or rubber type material about 0.250" (0.635 cm) in height and 0.125–0.250 inches (0.3175–0.635 cm) in diameter so as to add a deep massage effect on the user. The vibrator means 40 could advantageously include an electrical motor 42, such as that commercially available from Dremel Corp. A variable speed control 43 is preferably used to vary the intensity of vibration. Such a control 43 could be a potentiometer. Central vibrating source 41 could be a free spinning offset counterweight mechanism.

Central vibrating source 41 could be made of, for example, around cylindrical aluminum casing 45 approximately 1 inch to 1.5 inches (2.54 cm–3.81 cm) in diameter having a center shaft 46 supported by ball bearings 47 on opposite ends with a steel counter weight 48 mounted on the shaft 46 in a fixed position between the bearings 47.

Preferably, the electric source of vibration 42 is remote from the helmet 20 to avoid any potential problems with EMF (electromagnetic field) too close to the user's head. This is accomplished by having a flexible shaft 44, with one end of the shaft 44 at the motor 42 and the other end terminating in the central vibrating source 41 in the helmet 20. Thus, the mechanical means of vibration 41 is in the helmet 20 but the electrical portion 42 for powering the mechanical means 41 is remote from the user's head. Shaft 44 passes through hole 24 in helmet 20.

The helmet 20 is preferably shaped to cover a user's eyes, as shown in FIG. 3, to further help the user relax.

Preferably, there is a single vibrating means for the helmet with a single control to help keep the apparatus simple.

The present invention reduces tension and helps one relax.

Another embodiment of the invention is a vibrating chair for use with the helmet—the chair has an indentation for receiving the helmet and a vibratory vertical foot rest which preferably vibrates at about the same frequency as the helmet.

The helmet could be held in place with a chin strap or with a pair of loops through which one can put one's arms—the weight of the arms (preferably folded) will pull straight down on the helmet instead of pulling the helmet inward as a chin strap might do. The pair of loops allow the helmet to be used on persons who suffer from TMJ and are not able to accept the pressure that a conventional chin strap applies to the jaw area.

Adjustment slits 50 allow fine tuning of the shape of the helmet. Strap guides 55 help secure a strap (not shown) which is used to adjust the shape of the helmet by pulling the strap tight around the helmet 20.

The preferred embodiment of the present invention, apparatus 110, is shown in FIGS. 5–8. Apparatus 110 includes a helmet 120 which is similar to helmet 20 in that it includes an inner shell 121 and an optional hard outer shell 122. Apparatus 10 differs from apparatus 10 in that the rear of helmet 120 does not project downwardly as far as the rear of helmet 20 and in that helmet 120 includes handles 61 attached thereto. Handles 61 provide a means of allowing a facilitator of apparatus 110 to apply pressure to the head of a user of apparatus 110 during use. Handles 61 can be held in place with screws 62 or other fastening means. Adjustment slits 150 allow fine tuning of the shape of the helmet. Strap guides 155 help secure a strap (not shown) which is used to adjust the shape of the helmet by pulling the strap tight around the helmet 120. Shaft 44 passes through hole 124 in helmet 120.

A further advantage of the present invention is the utilization of ceramic magnets to further the effects of the device's blood flow increase principle which is to relax the user by the increase of blood flow to the head area of the human body.

Magnets are known to increase or produce increased blood flow when one places the north pole or positive-facing side of the magnet towards the body section to which increased blood flow is desired. The effect or therapeutic value of the use of magnet energy on the human body is thought to be effective because of the oscillation of the magnet by the movement of the user's body.

The present invention due to the vibratory nature of its internal mechanism promotes this oscillation effect thus creating a new and improved method for the use of magnets as in the increased blood flow to the head area of the human body.

Figure 6:
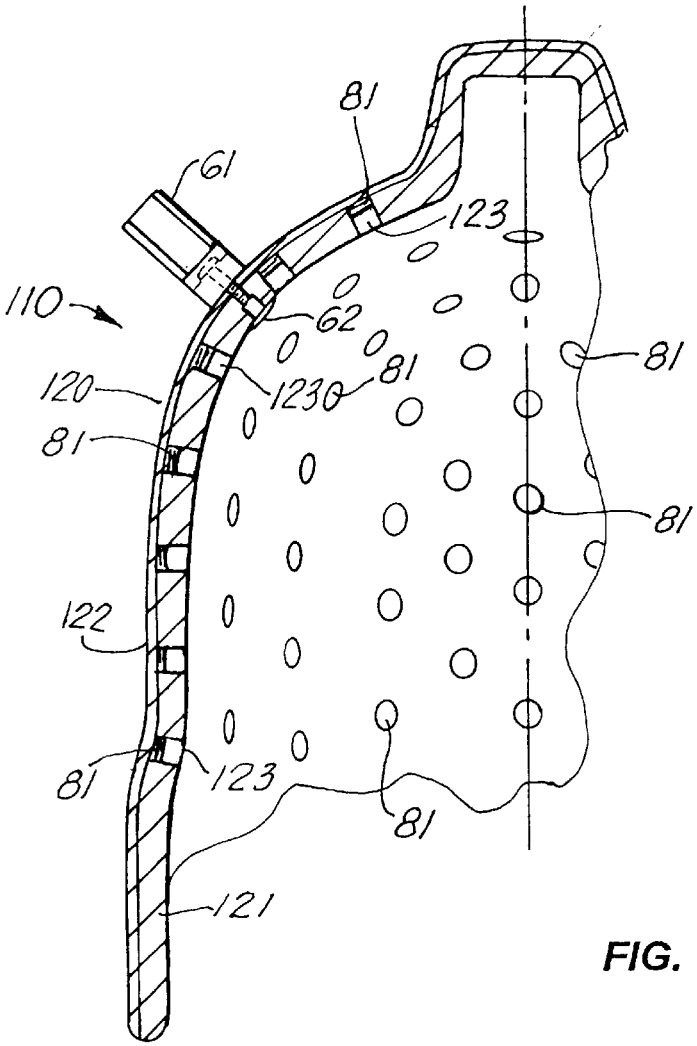
FIG. 6 is a cutaway view of the preferred embodiment of the helmet apparatus of the present invention.
Figure 7:
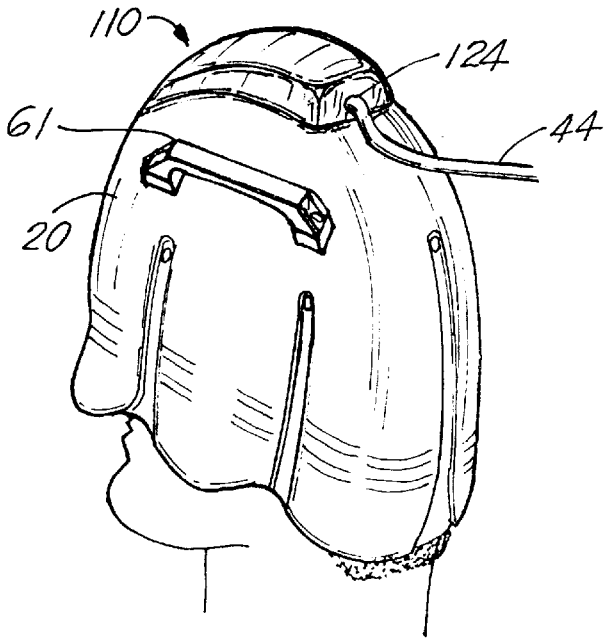
FIG. 7 is a perspective view of the preferred embodiment of the helmet apparatus of the present invention shown on a user.
Figure 8:
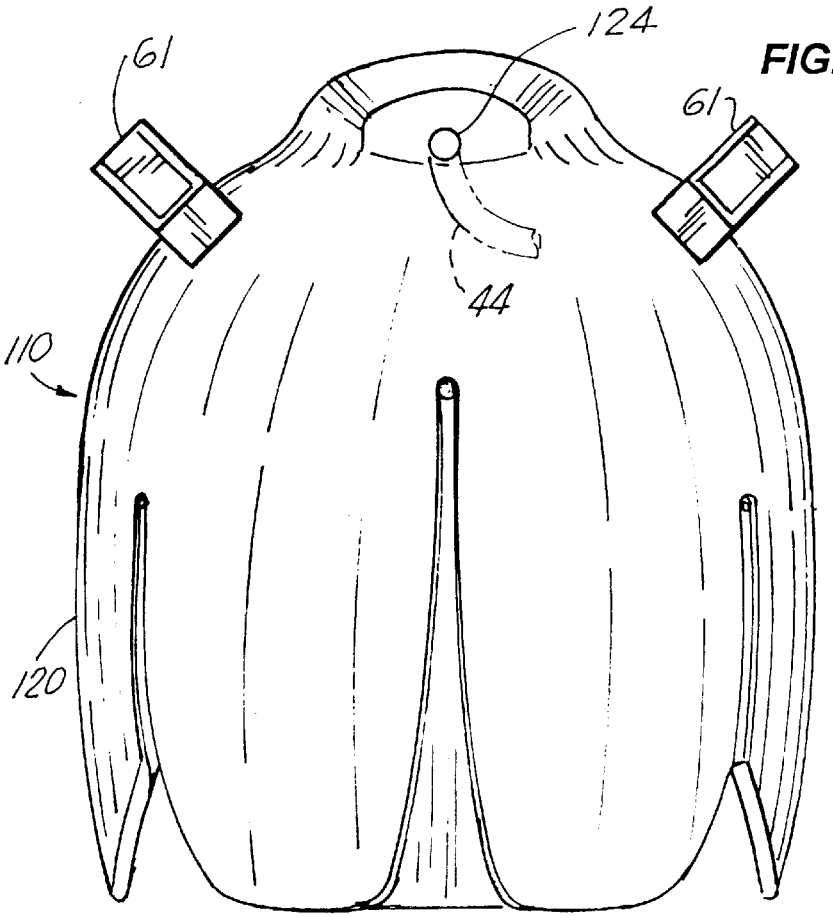
FIG. 8 is a rear view of the preferred embodiment of the helmet apparatus of the present invention.

Preferable, magnets 81 are included in the helmet apparatus 110 of the present invention (magnets 81 are shown in FIG. 6 in helmet apparatus 110). The magnets 81 may be attached to the inside of the helmet 120 by means of an adhesive such as glue. Alternatively, the magnets 81 may be molded into the core of the hard outer foam casing 122 during the manufacturing process. Preferably, magnets 81 are recessed into the helmet 120 so that they do not come into contact with the head of a user of apparatus 110 (see FIG. 6). Recesses 123 can be provided in inner shell 121 to allow magnets 81 to pass therethrough.

Magnets 81 could likewise be included in the same or a similar manner in apparatus 10.

The magnets 81 used in the present invention may be of various sizes, shapes and strengths. The magnets 81 can be, for example, round magnets which are about 0.125–0.375 inch (3.175–9.525 mm) thick and about 0.250–0.750 inch (6.35–19.05 mm) in diameter. They can be, e.g., round magnets 0.125 inch (3.175) thick×0.250 inch (6.35 mm) in diameter or 0.375 inch (9.525 mm) thick×0.750 inch (19.05 mm) in diameter in a grade 1 or grade 5 type magnet. They can be ceramic magnets, neodymium iron boron, sumarium cobalt, alnico, or flexible, but preferably, the magnets 81 are grade 5 type magnets in the 1250 through 3500 gauss range.

Clamping apparatus 70 (FIGS. 5 and 9) is an optional auxiliary pressure source. Clamping apparatus 70 includes opposed gripping jaws 72 attached to handles 71. Clamping apparatus 70 is optionally used in conjunction with helmet apparatus 10, 110. Handles 71 move the gripping jaws 72 from a position in which the gripping jaws 72 are open and can freely move over the helmet 20, 120 to a position in which the gripping jaws 72 are closed and put pressure on the helmet 20, 120 (see FIG. 5).

Gripping apparatus 70 includes a hinged connection 73 adjacent which connection gripping jaws 72 are attached to handles 71. There is an optional shock absorber 74. Gripping apparatus 70 could be made, for example, by modifying Fiskars Power-Lever® hedge shear model no. 9180 to replace the cutting mechanism with gripping jaws 72. U.S. Pat. No. 5,267,400 shows a similar hedge shear and is incorporated herein by reference.

Optional auxiliary pressure source 70 can be used by the facilitator or by an additional facilitator to apply more pressure on helmet 20 or 120 during vibration.

In operation, helmet 20 is put on the head of a user. Motor 42 is turned on and variable speed control 43 is used to adjust the speed of vibration. Motor 42, connected by flexible shaft 44 to central vibrating source 41, causes central vibrating source 41 to vibrate. The vibration from central vibrating source 41 travels through helmet 20 to the head of the user. The vibration travels through inner shell 21, outer shell 22, and vibration fingers 31. However, preferably only inner shell 21 comes into contact with the user's head. Usually, only a few minutes of vibration is necessary to achieve a desired level of comfort and relaxation.

The operation of helmet apparatus 110 is similar to that of helmet apparatus 10. In operation, helmet 120 is put on the head of a user. Motor 42 is turned on and variable speed control 43 is used to adjust the speed of vibration. Motor 42, connected by flexible shaft 44 to central vibrating source 41, causes central vibrating source 41 to vibrate. The vibration from central vibrating source 41 travels through helmet 120 to the head of the user. The vibration travels through inner shell 121, outer shell 122, and (if optional vibration network 30 is included in helmet 120) vibration fingers 31. However, preferably only inner shell 121 comes into contact with the user's head. A facilitator or the user can hold onto handles 61 and press or pull downward to apply pressure to the user's head during vibration. Also, or alternatively, a facilitator can apply pressure during vibration with auxiliary pressure apparatus 70. In some circumstances, a first facilitator can apply pressure during vibration using handles 61 and a second facilitator can apply pressure during vibration using apparatus 70. As with apparatus 10, usually, only a few minutes of vibration is necessary to achieve a desired level of comfort and relaxation using apparatus 110.

PARTS LIST

The following is a list of parts and materials suitable for use in the present invention:

10 helmet apparatus of the first embodiment of the present invention

20 vibrating helmet

21 inner shell of helmet 20 (made of, for example, ester, open cell urethane, open cell latex, having a density of preferably 1.0–2.5 lbs. per cubic foot (0.016019–0.0400475 g/cc), and more preferably 1.5–2.2 lbs. per cubic foot (0.0240285–0.0352418 g/cc), but could also be made of a gel type plastic material such as a 20–40 shore A Durometer plastisol)

22 optional outer shell of helmet 20 (made of, for example, a self-skinning urethane foam or PVC (polyvinyl chloride), ABS (acrylonitrile butadiene styrene resin), PET (polyethylene terephthalate, HDPE (high density polyethylene), urethane elastomer, or rigid plastisol, and having a Durometer hardness of about 50 shore A—95 shore D, preferably about 60–90 shore D, and most preferably about 70–90 shore D)

24 hole in helmet 20 for shaft 44

30 vibration distribution network (optional and may be omitted when some materials, such as a self-skinning urethane foam or PVC (polyvinylchloride), ABS (acrylonitrile butadiene styrene resin), PET (polyethylene terephthalate, HDPE (high density polyethylene), urethane elastomer, or rigid plastisol, and having a Durometer hardness of about 40–95 shore D, preferably about 60–90 shore D, and most preferably about 70–90 shore D), are used for outer shell 22 or 122)

31 distribution fingers of network 30

40 vibrator means

41 central vibrating source

42 motor

43 variable speed control

44 flexible shaft (made of, for example, a steel cable inside of a hard plastic shell casing)

45 round cylindrical casing made of, for example, aluminum

46 center shaft of central vibrating source 41

47 ball bearings of central vibrating source 41

48 steel counter weight (made of, for example, steel)

50 adjustment slits

55 strap guides

61 handles on helmet 120 (made of, for example, aluminum, steel, plastic, or wood)

62 screws (made of, for example, aluminum, steel, or plastic)

70 optional auxiliary pressure source

71 handles of auxiliary pressure source 70 (made of, for example, aluminum, steel, rigid plastic, or wood)

72 gripping jaws of auxiliary pressure source 70 (made of, for example, aluminum, steel, or rigid plastic)

73 hinged connection of auxiliary pressure source 70 (made of, for example, steel or aluminum)

74 shock absorber of auxiliary pressure source 70 (made of, for example, rubber or flexible plastic)

81 magnets (for example, having a strength of about 1250–3500 gauss)

110 helmet apparatus of the preferred embodiment of the present invention

120 vibrating helmet

121 inner shell of helmet 120 (made of, for example, ester, open cell urethane, open cell latex, having a density of preferably 1.0–2.5 lbs. per cubic foot (0.016019–0.0400475 g/cc), and more preferably 1.5–2.2 lbs. per cubic foot (0.0240285–0.0352418 g/cc), but could also be made of a gel type plastic material such as a 20–40 shore A Durometer plastisol)

122 optional outer shell of helmet 120 (made of, for example, a self-skinning urethane foam or PVC (polyvinyl chloride), ABS (acrylonitrile butadiene styrene resin), PET (polyethylene terephthalate, HDPE (high density polyethylene), urethane elastomer, or rigid plastisol, and having a Durometer hardness of about 50 shore A—95 shore D, preferably about 60–90 shore D, and most preferably about 70–90 shore D)

124 hole in helmet 120 for shaft 44

150 adjustment slits

155 strap guides

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. Apparatus for facilitating relaxing, comprising:

a helmet made of a soft material;

a vibrating means in the helmet;

a mechanical power source remote from the helmet for powering the vibrating means in the helmet so that the user is not exposed to electromagnetic field from the power source;

a flexible shaft for transmitting mechanical energy from the mechanical power source to the vibrating means in the helmet; and relatively hard transmission means for transmitting vibration from the vibrating means throughout the helmet.

2. The apparatus of claim 1, wherein the helmet is shaped to cover a user's eyes during use.

3. The apparatus of claim 1, further comprising:

magnets in the helmet.

4. The apparatus of claim 3, wherein the helmet is shaped to cover a user's eyes during use.

5. The apparatus of claim 3, wherein the magnets have a strength of about 1250–3500 gauss.

6. The apparatus of claim 3, wherein the magnets are round and have a diameter of about 0.250–0.750 inch (6.35–19.05 mm) and a thickness of about 0.125–0.375 inch (3.175–9.525 mm).

7. The apparatus of claim 1, further comprising a clamping apparatus, for use in conjunction with the helmet, the clamping apparatus including:

opposed gripping jaws;

handles for moving the gripping jaws from a position in which the gripping jaws are open and can freely move over the helmet to a position in which the gripping jaws are closed and put pressure on the helmet.

8. The apparatus of claim 7, wherein the helmet is shaped to cover a user's eyes during use.

9. The apparatus of claim 1, wherein the helmet includes a shell made of a material having a density of about 1.0–2.5 lbs. per cubic foot (0.016019–0.0400475 g/cc).

10. The apparatus of claim 1, wherein the helmet includes an inner shell made of a material having a density of about 1.0–2.5 lbs. per cubic foot (0.016019–0.0400475 g/cc), and an outer shell made of a material having a Durometer hardness of about 50 shore A—95 shore D.

11. The apparatus of claim 1, further comprising handles on the helmet.

12. The apparatus of claim 1, further comprising:

magnets in the helmet; and a clamping apparatus, including opposed gripping jaws and handles for moving the gripping jaws from a position in which the gripping jaws are open and can freely move over the helmet to a position in which the gripping jaws are closed and put pressure on the helmet.

13. A method of facilitating relaxing, comprising:

providing the apparatus of claim 12;

placing the helmet on a user's head;

causing the helmet to vibrate.

14. The method of claim 13, wherein pressure is provided on the helmet during vibration by pressing down on or pulling down on handles attached to the helmet.

15. The method of claim 14, wherein pressure is also provided on the helmet during vibration with an auxiliary pressure means gripping the helmet.

16. The method of claim 13, wherein pressure is provided on the helmet during vibration with an auxiliary pressure means gripping the helmet.

17. A method of facilitating relaxing, comprising:

providing the apparatus of claim 1;

placing the helmet on a user's head;

causing the helmet to vibrate.

18. Apparatus for facilitating relaxing, comprising:

a helmet made of a soft material;

a vibrating means in the helmet;

a mechanical power source remote from the helmet for powering the vibrating means in the helmet so that the user is not exposed to electromagnetic field from the power source; and a flexible shaft for transmitting mechanical energy from the mechanical power source to the vibrating means in the helmet.

19. The apparatus of claim 18, wherein the helmet is shaped to cover a user's eyes during use.

* * * * *